US006190148B1

(12) United States Patent
Ni

(10) Patent No.: US 6,190,148 B1
(45) Date of Patent: Feb. 20, 2001

(54) SCROLL-TYPE FLUID DISPLACEMENT DEVICE HAVING SLIDING SURFACE THRUST BEARING

(75) Inventor: Shimao Ni, Shanghai (CN)

(73) Assignee: Mindtech Corporation, Willowbrook, IL (US)

( * ) Notice: Under 35 U.S.C. 154(b), the term of this patent shall be extended for 0 days.

(21) Appl. No.: 09/068,788

(22) PCT Filed: Nov. 15, 1996

(86) PCT No.: PCT/CN96/00102

§ 371 Date: Sep. 30, 1998

§ 102(e) Date: Sep. 30, 1998

(87) PCT Pub. No.: WO97/19269

PCT Pub. Date: May 29, 1997

(30) Foreign Application Priority Data

Nov. 17, 1995 (CN) ..... 95119843

(51) Int. Cl.[7] ..... F01C 1/02
(52) U.S. Cl. ..... 418/55.6; 418/100
(58) Field of Search ..... 418/55.6, 100

(56) References Cited

U.S. PATENT DOCUMENTS 801,182 * 10/1905 Creux .
4,734,020 * 3/1988 Kaisha .
5,358,392 * 10/1994 Ukai ..... 418/55.6
5,470,213 * 11/1995 Iguchi et al. ..... 418/55.3 X
5,683,237 * 11/1997 Hagiwara et al. ..... 418/55.6 X
5,888,057 * 3/1999 Kitano et al. ..... 418/55.6 X

FOREIGN PATENT DOCUMENTS

1074512 * 7/1993 (CN) .
1096857 * 12/1994 (CN) .
0 157 300 * 10/1985 (EP) .
20157390 * 10/1985 (EP) .
0 574 104 * 12/1993 (EP) .
10574104 * 12/1993 (EP) .

* cited by examiner

*Primary Examiner*—Hoang Nguyen
(74) *Attorney, Agent, or Firm*—Merchant & Gould P.C.

(57) ABSTRACT

In a scroll-type fluid displacement compression apparatus, the structure, names as a two-way gas suction and an oil-gas mixed lubrication plate thrust bearing and a one-side Oldhams ring, makes the mixture of oil and gas, which is entered into the apparatus, flowing in two directions such that most of the working gas media is changed the flowing direction and sucked into the suction chamber of the scroll members directly while most of lubrication oil-fog flows on the sliding plate thrust bearing through certain passages and lubricates it well. The supporting area of the sliding plate thrust bearing can be enlarged due to the structure of the one-sided Oldhams rings. As a result, the displacement scroll-type fluid compression apparatus can be used in a wide variable range of speed and variable angle positions.

6 Claims, 4 Drawing Sheets

SCROLL-TYPE FLUID DISPLACEMENT DEVICE HAVING SLIDING SURFACE THRUST BEARING

BACKGROUND OF THE INVENTION

This invention relates in general to a fluid displacement device. More particularly, it relates to an improved scroll-type fluid displacement device with a "sliding surface thrust bearing" and a "two way suction oil-gas passages" to assure sufficient lubricant supply to the thrust bearing under oil-mist lubrication condition and an "oldham ring with one sided keys" to maximize the working area of the sliding surface thrust bearing for variable speed applications.

Scroll-type fluid displacement devices are well-known in the art. For example, U.S. Pat. No. 801,182 to Creux discloses a scroll device including two scroll members each having a circular end plate and a spiroidal or involute scroll element. These scroll elements have identical spiral geometry and are interfit at an angular and radial offset to create a plurality of line contacts between their spiral curved surfaces. Thus, the interfit scroll elements seal off and define at least one pair of fluid pockets. By orbiting one scroll element relative to the other, the line contacts are shifted along the spiral curved surfaces, thereby changing the volume of the fluid pockets. This volume increases or decreases depending upon the direction of the scroll elements' relative orbital motion, and thus, the device may be used to compress or expand fluids.

Referring to FIGS. 1*a*–1*d,* the general operation of conventional scroll compressor will now be described. FIGS. 1*a*–1*d* schematically illustrate the relative movement of interfitting spiral-shaped scroll elements, 1 and 2, to compress a fluid. The scroll elements, 1 and 2, are angularly and radially offset and interfit with one another. FIG. 1*a*shows that the outer terminal end of each scroll element is in contact with the other scroll element, i.e., suction has just been completed, and a symmetrical pair of fluid pockets A1 and A2 has just been formed.

Each of FIGS. 1*b*–1*d* shows the position of the scroll elements at a particular drive shaft crank angle which is advanced from the angle shown in the proceeding figure. As the crank angle advances, the fluid pockets, A1 and A2, shift angularly and radially towards the center of the interfitting scroll elements with the volume of each fluid pockets A1 and A2 being gradually reduced. Fluid pockets A1 and A2 merge together at the center portion A as the crank angle passes from the state shown in FIG. 1*c* to the state shown in FIG. 1*d.* The volume of the connected single pocket is further reduced by an additional drive shaft revolution. During the relative orbit motion of the scroll elements, outer spaces, i.e. the suction chambers, which are shown as open in FIG. 1*b* and 1*d,* change to form new sealed off fluid pockets in which the next volume of fluid to be compressed is enclosed (FIGS. 1*c* and 1*a* show these states).

In some applications, such as in automobile air conditioning compressors, the compressor rotates at a speed variable from 800–6000 rpm, which is a big challenge to the thrust bearing of the compressor. It is unreliable to lubricate the thrust bearing in an automobile air conditioning compressor by an oil pump which is used in residential air conditioning compressors. It is because the oil level in the oil sump of an automobile air conditioning compressor constantly changes depending on the posture of the automobile, up hill, down hill or horizontal. Therefore, an oil mist lubrication scheme has been widely used in existing technology of automobile air conditioning compressors. In this scheme the amount of oil supplied to bearings is limited. The sliding surface thrust bearing with sufficient lubrication is inexpensive and capable to provide quiet operation and stable support. It is successfully used in residential scroll air conditioning compressors, but is not used in the automobile scroll air conditioning compressors due to the above mentioned reason. In stead, in an automobile air conditioning compressor, thrust ball bearing is used. The ball thrust bearing, for example, used in the scroll air conditioning compressors made by Sanden Corporation, tolerates less lubrication. However, the ball thrust bearing is expensive. It makes loud noises at high speed and wears out quickly due to the high contact stresses at the contact points between the balls and the races.

The present invention provides an improved scroll-type fluid displacement device. By providing a mechanism of two way suction oil-gas passages, most oil in the oil mist is collected and then directed to the sliding surface thrust bearing to meed the lubrication requirement and at the same time the suction pressure losses is minimized. The sliding surface thrust bearing is capable to operate at rotation speeds variable in a wide range. An oldham ring with one sided keys allows to maximize the working surface of the thrust bearing.

SUMMARY OF THE INVENTION

Accordingly, it is an object of the present invention to provide a scroll-type fluid displacement device in which a sliding surface thrust bearing with maximum effective bearing surface is capable to operate at variable rotation speeds.

It is also an object of the present invention to provide a mechanism of two way suction oil-gas passages. The most of oil in the return mixture of the refrigerant and oil mist is collected to form oil rich mixture when passing the passages. The oil rich mixture is directed to lubricate the sliding surface thrust bearing. The most of the refrigerant gas directly flows to the suction ports of the scroll device. Thus, the suction pressure loss is minimized.

In order to implement these and other objects, the disclosed embodiment of the present invention provide a scroll-type fluid displacement device, which includes a housing having a fluid inlet port and a fluid outlet port. A first scroll member has an end plate from which a first scroll element extends axially into the interior of the housing. A second scroll member also has an end plate from which a second scrolled element extends axially. The second scroll member is movably disposed for non-rotative orbital movement relative to the first scroll member. A sliding surface thrust bearing supports the second end plate of the second scroll member.

The first and second scroll elements interfit at an angular and radial offset to create a plurality of line contacts which define at least one pair of sealed fluid pockets. Drive means is operatively connected to the scroll members to effect their relative orbiting motion while preventing their relative rotation by an oldham ring, thus causing the fluid pockets to change volume.

The disclosed embodiments of the present invention provide mechanism of two way suction oil-gas passages. The mixture of refrigerant and oil mist entering the housing through the fluid inlet port can flow along two passages in two different directions. One direction is the direct extension of the inlet port, leading the mixture to the center portion of the housing and the sump. The most of oil mist and droplets flow in this direction due to the large inertia caused by its high density to form a mixture rich in oil mist. The oil rich mixture flows thorough the gaps in the main shaft bearing and through the radial passages at the working surface of the thrust bearing and thus lubricate the thrust bearing surface. The other direction is a sharp running from the inlet port to the suction chambers formed by two scroll members where is at the lowest pressure in entire housing. Most refrigerant gas driven by the pressure differential between the inlet port and the suction chambers makes a sharp turning and flow to the suction chambers. Thus the pressure drop of the return refrigeration gas is minimized.

In another aspect of the present invention the scroll-type fluid displacement device includes a sliding surface thrust bearing which has at least one radial passage on its working surface to allow the oil rich mixture form the gap in the main shaft bearing flowing through and lubricating the working surface of the thrust bearing and, then flowing to the suction chamber.

In another aspect of the present invention the radial passages at the working surfaces of the thrust bearing are arranged in such a way that the minimum distance from any point at the working surfaces to the radial passages is not large than the diameter of the non-rotational orbiting motion of the second scroll member.

In yet another aspect of the present invention a oldham ring has two groups of keys located at the same side of the ring and thus is called "oldham ring with one sided keys", there are two keys in each group and they are located at the two ends of diameter, the centerline of the two groups of keys are perpendicular to each other. The ring and the second scroll member are located on the different sides of the sliding surface thrust bearing.

BRIEF DESCRIPTION OF THE DRAWINGS

The invention will be better understood when considered in view of the following detailed description which makes reference to the annexed drawings in which.

DETAILED DESCRIPTION OF THE PRESENTLY PREFERRED EMBODIMENTS

Figure 1B:
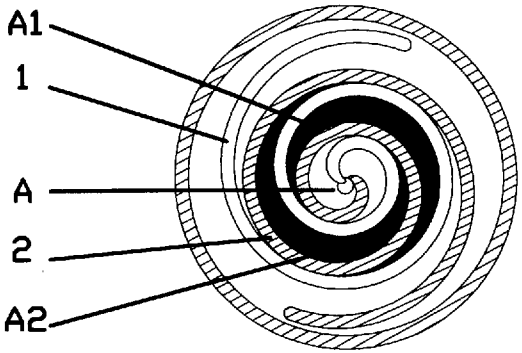
FIGS. 1*a*–1*d* are schematic views illustrating the relative orbital movement of the scroll elements in a conventional scroll compressor.
Figure 1D:
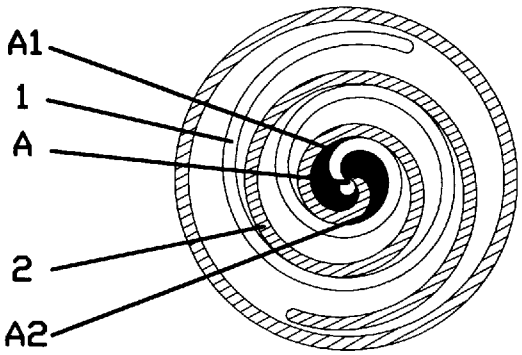
Figure 1A:
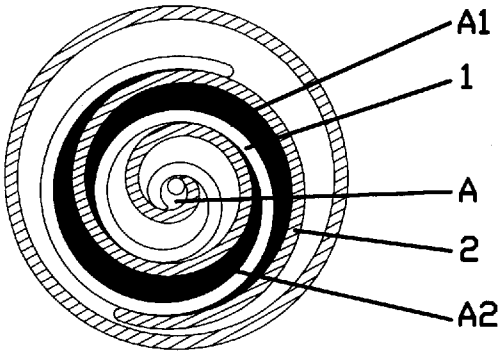
Figure 1C:
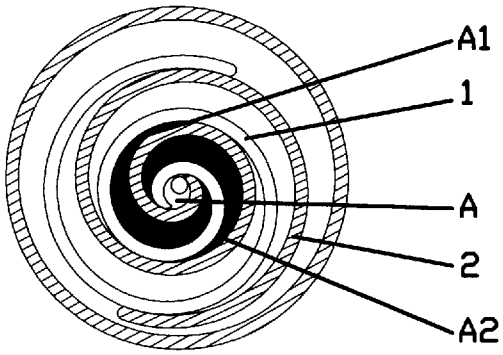
Figure 2:
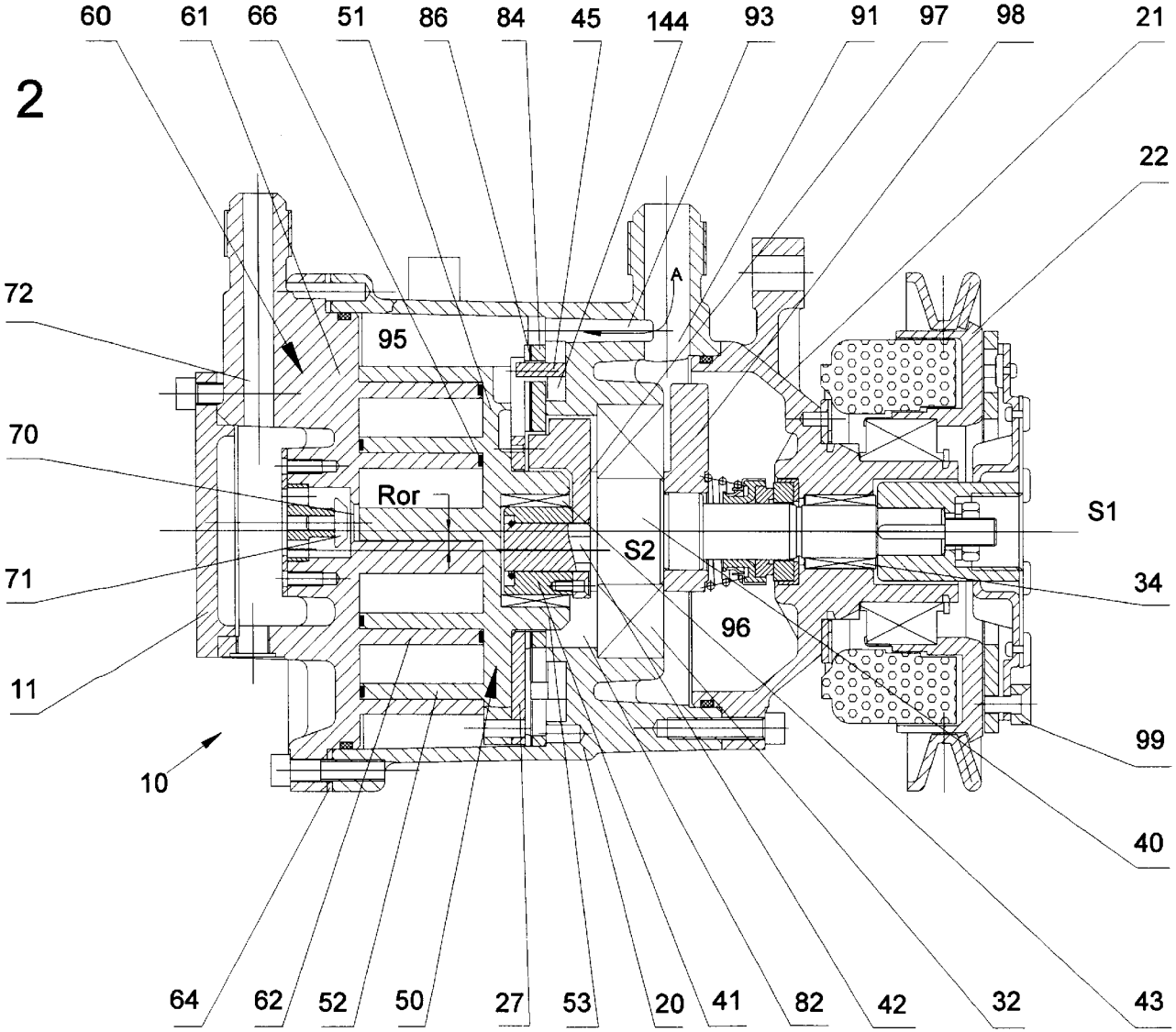
FIG. 2 illustrates a cross section of a scroll-type automobile air conditioning compressor with two way suction oil-gas passages in accord with the present invention.

Referring to FIG. 2 a scroll-type automobile air conditioning compressor designed in accordance with the present invention is shown. The compressor unit 10 includes a main housing 20, a front shell 21, a rear cover 11 and a first scroll member (fixed scroll member) 60 all together forming the compressor shell body. The main housing 20 holds a main bearing 32. A main shaft 40 is rotatably supported by main bearing 32 and rear bearing 34 held by the front shell 21 and rotates along its axis $S_1$—$S_1$ when driven by an electric magnetic clutch 22.

A drive pin 42 extrudes from the rear end of main shaft 40, and the central axis of drive pin, $S_2$—$S_2$, is offset from the main shaft axis, $S_1$—$S_1$, by a distance equal to the orbiting radius Ror of the second scroll member (orbiting scroll member) 50. The orbiting radius is the radius of the orbiting circle which is traversed by the second scroll member 50 as it orbits relative to the first scroll member 60.

The first scroll member 60 has an end plate 61 from which a scroll element 62 extends. The first scroll member is perpendicular to the axis $S_1$—$S_1$ and is attached to the surface 64 of the main housing 20 such that appropriate grasps between the tips of one scroll member and the bases of the other scroll member are maintained.

These gaps must be wide enough to prevent the tops and bases of the scroll members from contacting each other after taking into consideration the manufacturing tolerances and thermal growth of the scroll elements during normal operation. On the other hand, the gaps must also be small enough to be sealed off mechanically by the tip seals 66 located in the spiral shaped groove in the tips of the scroll members and hydrodynamically by a film of lubricant during normal operation.

The second scroll member 50 includes a circular end plate 51, a scroll element 52 affixed to and extending from the rear surface of the end plate 51, and an orbiting bearing boss 53 affixed to and extending from the front surface of the end plate 51.

Scroll elements 52 and 62 are interfit at a 180 degree angular offset, and at a radial offset having an orbiting radius Ror. At least one pair of sealed off fluid pockets is thereby defined between scrolled elements 52 and 62, and end plates 51 and 61. The second scroll member 50 is connected to a driving pin 42 via a driving pin bearing 43 and driving knuckle 41. The function of the oldham ring 45 is to prevent the seconds scroll member 50 from rotating. The second scroll member 50 is driven in an orbiting motion at the orbiting radius Ror by rotation of the drive shaft 40 to thereby compress fluid. The working fluid from the inlet port 91 via intermediate passage 93 enters the suction chambers 95 formed by the scroll elements 50 and 60, then compressed by the scroll elements and finally discharged through discharge port 70 via passages 71 and 72. After the mixture of the refrigerant and oil mist enters the suction port 91, most refrigerant gas changes its direction of flow, as shown by arrow A, and flows with small amount of oil mist via passage 93 to suction chambers 95. Most of oil mist due to its high density continues to flow towards the central portion of the housing after its enters the compressor. The rich oil mist from the inlet port together with the oil droplets which is in the oil sump 96 and splashed up by the counterweight 98, flows via gaps in the main bearing 32 to the central chamber 82, the flows through the radial passages 86 on the stationary thrust bearing 84 and at the same time lubricates the thrust bearing.

The counterweights 97, 98 and 99 balance the centrifugal forces caused by the orbiting motion and rotation of the second scroll member 50, the moving thrust bearing 27, driving knuckle 41 and driving pin 42, respectively.

Figure 3B:
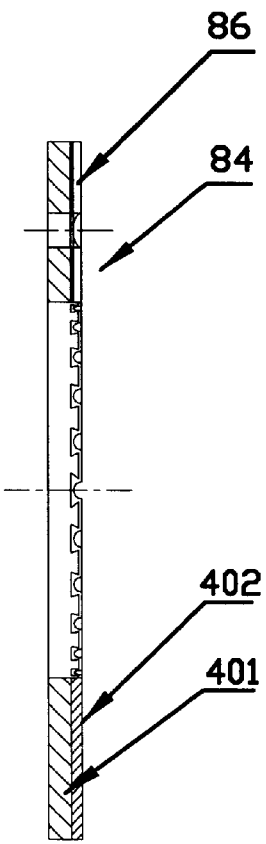
FIGS. 3*a*–3*b* illustrate a sliding surface thrust bearing with radial passages through which a rich oil mist flows thorough and thereby lubricates the thrust bearing in accord with the present invention.
Figure 3A:
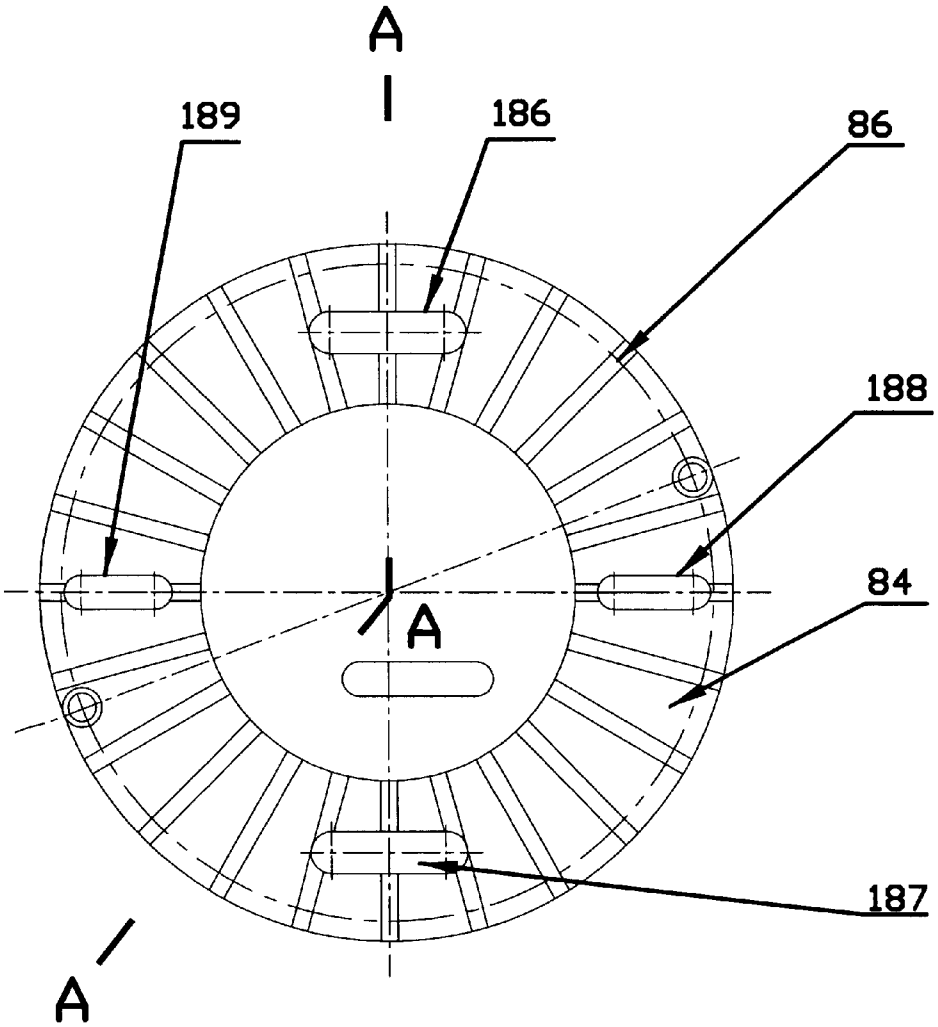

Referring to FIGS. 3*a*–3*b*, the stationary thrust bearing 84 fixed to the main housing 20 is shown. FIG. 3*a* is the front view and FIG. 3*b* is a cross-section view along line A—A. The base 401 of the stationary thrust bearing is gray cast iron coated by a layer 402 of babbit alloy. There are several radial grooves 86 on the working surface of the stationary thrust bearing 84. However, the grooves can also be located on the moving thrust bearing 27 (FIG. 2) or on both stationary and moving thrust bearings. Nevertheless, the following principles of the arrangement of the passages 86 are important:

1) The passages should allow the rich oil mist to wet the entire surface of the thrust bearing and allow the rich oil mist flow through to the suction chambers 95;

2) The minimum distance from any point on the working surface of the sliding surface thrust bearing to the passages should not be significantly greater than the diameter of the non-rotational circular orbiting motion of the second scroll member 50. Therefor, any point on the working surface of the moving thrust bearing has the opportunity to be wetted by the rich oil mist flowing in the passage and thus be lubricated. On the other hand, the moving thrust bearing's wet surface brings oil to the working surface of the stationary thrust bearing 84 on the main housing. Thus, sufficient lubrication to the sliding surface thrust bearings is assured.

The rich oil mist passes through passages 86 and enters suction chambers 95. The arrangement of the passages 86 can be various as long as the above mentioned principles are followed, sufficient lubrication to the thrust bearings can be assured.

Figure 5B:
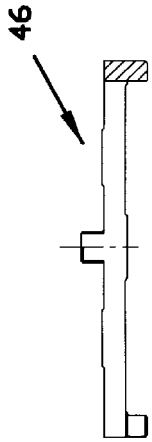
FIGS. 5*a*–5*b* illustrate a typical oldham ring of existing art.
Figure 5A:
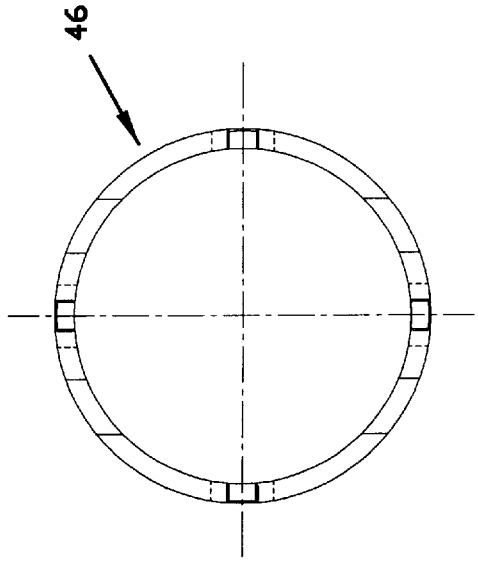
Figure 4B:
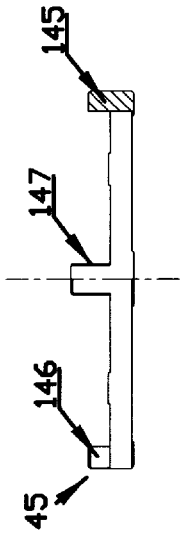
FIGS. 4*a*–4*b* illustrate a "oldham ring with one sided keys" in accord with the present invention.
Figure 4A:
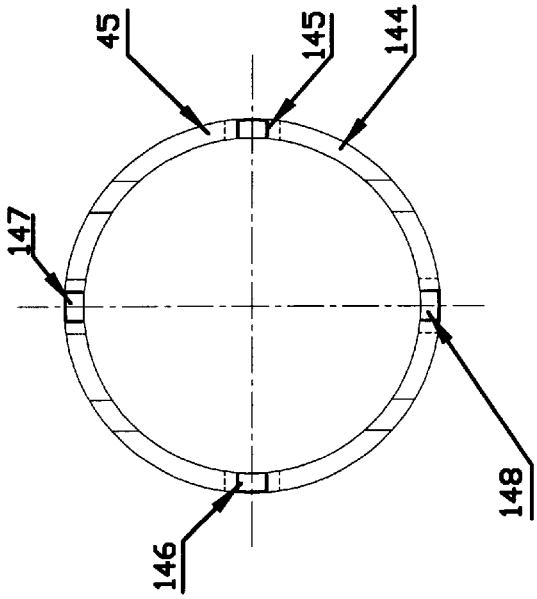

Referring to FIGS. 4*a* and 4*b,* the "oldham ring with one sided keys" is shown. On the same side of the circular ring 45, four rectangular keys are equally spaced. This is different from the old ring of existing arts (shown in FIGS. 5*a*–5*b*). The four keys are divided as two groups, high keys and low keys. The oldham ring 45 are located underneath the stationary thrust bearing 84 (see FIG. 2). The two low keys 145 and 146 (FIGS. 4*a* and 4*b*) are inserted into the grooves 188 and 189 of the stationary thrust bearing 84 (FIG. 3*a*) and can slide in the grooves, respectively. The high keys 147 and 148 extend through grooves 186 and 187 and can slide in the grooves on the moving thrust bearing 27. In existing arts the oldham ring slides at the close vicinity where the stationary thrust surface is located, thus limits the working area of the stationary thrust bearing. Since the oldham ring with one sided keys is located underneath the stationary thrust bearing, it allows to maximize the working area of the stationary thrust bearing.

While the above described embodiments of the invention are preferred, those skilled in the art will recognize modifications of structure, arrangement, composition and the like which do not part from the true scope of the invention. The invention is defined by the appended claims, and all devices and/or methods that come within the meaning of the claims, either literally or bye equivalents, are intended to be embraced therein.

I claim:

1. A scroll-type fluid displacement apparatus comprising:

a shell body having a lubricant sump and an inlet port and an outlet port, the working fluid and lubricant enters the apparatus thorough the inlet port;

a first scroll member fixed to the shell body having a first end plate and from which a first scroll element extends;

a second scroll member having a second end plate and from which a second scroll element extends;

said first and second scroll elements positioned relative to one another such that they meet at line contacts and form sealed off pockets and suction chambers;

a shaft driving said second scroll member to make a non-rotational orbiting motion relative to said first scroll member, thereby changing the volume of the sealed off pockets;

a stationary sliding surface thrust bearing supporting said second scroll member, said stationary sliding surface thrust bearing includes a working surface;

an oldham ring preventing rotation of said second scroll member; and at least two circuits to allow working fluid and lubricant to continue to flow from said inlet port, a first circuit of said circuits includes a intermediate passage to make most working fluid from said inlet port change its direction of flow and flow to said suction chambers; and a second circuit of said circuits includes a first passage which is the direct extension of said inlet port to allow most of the lubricant to flow to said lubricant sump; a second passage to allow lubricant from said first passage to flow to a central chamber of said stationary sliding surface thrust bearing and a third passage on the working surface of said stationary sliding surface thrust bearing allowing the mixture of the working fluid and lubricant mist from said second passage to flow through and thereby to lubricate the stationary thrust bearing and then flow to said suction chambers.

2. The apparatus of claim 1, further including a moving sliding surface thrust bearing affixed to said second end plate of said second scroll member, said moving sliding surface thrust bearing including a working surface.

3. The apparatus of claim 2 wherein said third passage of said second circuit includes at least one radial groove; said at least one radial groove is arranged such that the minimum distance from any point on the working surfaces of said sliding thrust bearings to said third passage of said second circuit is not greater than the diameter of the non-rotational circular orbiting motion of said second scroll member.

4. The apparatus of claim 3 wherein said at least one radial groove is located on the working surfaces of said stationary and/or moving sliding surface thrust bearings.

5. The apparatus of claim 4 wherein said at least one radial groove is arranged from the central portion to the peripheral portion of said stationary and/or moving sliding surface thrust bearings.

6. The apparatus of claim 5 wherein said second passage of said second circuit consists of passages formed by gaps in a main bearing supporting said shaft, the passages allowing the mixture of the working fluid and lubricant mist to flow through to the central portion of said thrust bearing and thorough said third passage to lubricate the working surfaces of said stationary and moving thrust bearings and then flow to said suction chambers.

* * * * *